United States Patent [19]

Divers

[11] 4,266,829

[45] May 12, 1981

[54] COMBINED ROTATING BED SCRUBBER AND WATER ELIMINATOR

[75] Inventor: Edward F. Divers, Pittsburgh, Pa.

[73] Assignee: The United States of America as represented by the Secretary of the Interior, Washington, D.C.

[21] Appl. No.: 85,451

[22] Filed: Oct. 16, 1979

[51] Int. Cl.[3] ..... E21C 35/02; B01D 46/18

[52] U.S. Cl. ..... 299/64; 55/233; 55/400; 55/528; 299/12

[58] Field of Search ..... 55/91, 90, 92, 96, 97, 55/233, 259, 306, 400–409, 467, 522, 524, 527, 528, DIG. 25; 299/12, 64

[56] References Cited

U.S. PATENT DOCUMENTS

| | | | |
|---|---|---|---|
| 2,648,396 | 8/1953 | Kirby | 55/400 |
| 3,022,859 | 2/1962 | Sexton | 55/90 |
| 3,240,002 | 3/1966 | O'Rourke et al. | 55/400 |
| 3,370,401 | 2/1968 | Lucas et al. | 55/90 |
| 3,387,889 | 6/1968 | Ziemba et al. | 55/223 |
| 3,700,284 | 10/1972 | Agnew | 299/12 |
| 3,792,568 | 2/1974 | Gundlach et al. | 55/223 |
| 3,810,677 | 5/1974 | David | 299/64 |
| 4,006,938 | 2/1977 | Reiterer | 55/406 |
| 4,158,449 | 6/1979 | Sun et al. | 55/306 |

FOREIGN PATENT DOCUMENTS

| | | | |
|---|---|---|---|
| 2505125 | 8/1976 | Fed. Rep. of Germany | 55/400 |
| 42-3560 | 9/1967 | Japan | 55/400 |
| 762433 | 11/1956 | United Kingdom | 55/317 |

*Primary Examiner*—Bernard Nozick

*Attorney, Agent, or Firm*—Thomas Zack; Donald A. Gardiner

[57] ABSTRACT

A device used as a combined scrubber and water droplet eliminator which may be employed in removing particulate from air, especially in conjunction with an underground mining machine. The scrubber is made of a fibrous bed material and is rotatable by a motor forming part of a bed assembly. Adjacent to the rotatable bed are water sprays directed to spray towards and on the bed as it rotates. A suitable air movement device, such as a fan, draws dust-laden and water drop-laden air to the rotating bed. The air goes through the bed and the dust and water particles impact the bed's rotating wetted fibers and are forced radially directly outward. The bed's rotation takes place against the inlet portion of a stationary bell mouth assembly. An air seal caused by the air pressure differential seals the rotating bed to the inside surface of the assembly. The rotating bed causes particles and water to be moved towards the bed's circumference where an open weave allows the particles and water to be dispersed in a continuous flushing action.

3 Claims, 2 Drawing Figures

COMBINED ROTATING BED SCRUBBER AND WATER ELIMINATOR

BACKGROUND OF THE INVENTION

1. Field of the Invention:

This invention is an air scrubber for removing dust particles and water from air.

2. Description of the Prior Art

Particulate matter has been removed from the air around mining operations by a variety of mechanisms such as improved ventilation and air scrubbers. These air scrubbers have consisted of suction devices attached to mining machines that frequently use a filter and a flow of water within the filter. U.S. Pat. No. 3,387,889 (Ziemba) discloses such a system. In the air scrubber disclosed in the U.S. Pat. No. 3,792,568 to Gundlach, polluted air is subjected to a liquid spray as it enters into a chamber having a revolving rotor member. Centrifugal processing is used in the David U.S. Pat. No. 3,810,677 for the dust collector to wet and separate the dust. Another related prior art reference is the U.S. Pat. No. 3,370,401 to Lucas which discloses a wetted, stationary fibrous media.

This invention is made up of a thin, dense, uniform smooth face rotating bed of flooded mesh wire cloth which acts both as a particulate deflection mechanism and as the slurry eliminating system. The centrifugal action of the bed forces the dust-laden water and large particulate from the outer periphery of the bed. A fan draws the dust and water drop laden air through the rotating bed and helps to form an air seal near the bed's periphery. It is the impact between the water droplets, bed wire, and dust particles which causes the wetted particles to be thrown off the bed for later collection. Combined with the applied centrifugal forces, particles are slung off from the open weave to provide a continuous flushing or cleaning action for the bed.

The essential difference between this invention and the cited and known prior art resides in the construction and operation of the rotating fibrous bed. In this invention the bed itself is rotated, flooded with a liquid, and made of fibrous mesh wire cloth of uniform density with a smooth upstream surface. An air seal formed around the inside downstream edge of the rotating bed and the stationary lip of the bell-mouth entry prevents air from passing therethrough. This design not only produces a bed with high dust collection efficiency, but also a self-cleaning dual functioning scrubber and droplet eliminator at a minimum size and cost.

Various test results conducted on a selected group of scrubbers including those embodying this invention can be found in the U.S. Bureau of Mines report entitled "Scrubbers for Dust Control: A Comparison Six Medium-Energy Use Types" authored by Joseph T. Janosik and myself.

SUMMARY OF THE INVENTION

The combined air scrubber and water eliminator forming this invention can be used in conjunction with a mining machine to clean dust-laden air. The focal point of the invention is its smooth faced, air sealed rotating fibrous bed which is continuously wetted by water sprays as the to be scrubbed air is forced through it. Forming the bed is a thin, dense, uniform thickness, smooth upper surface mesh wire cloth. As the bed is rotated, centrifugal forces sling the large dust-laden water and particulates from the outer periphery of the bed to settle by gravity, or to a collection system that removes them from the working area.

The primary object of this invention is an improved air scrubber and water eliminator.

Figure 1:
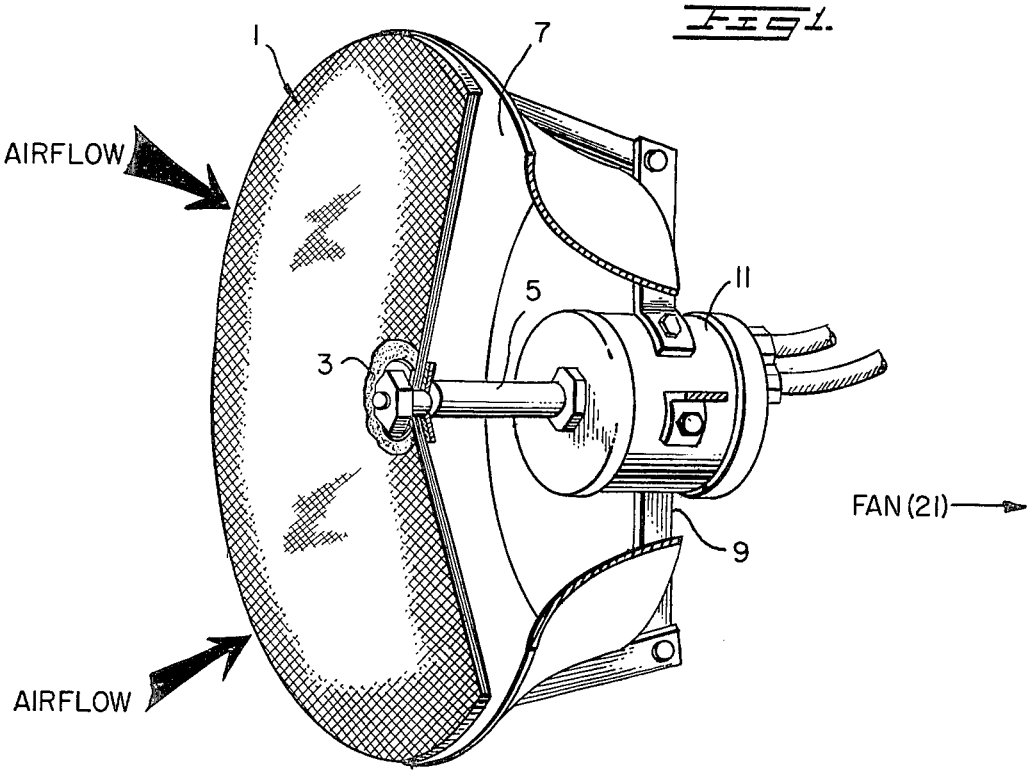
FIG. 1 is an isometric view of the scrubber with a section cut away.

The basic components of the invention are shown in FIG. 1. The thin, dense, uniform thickness smooth face rotatable bed 1 is made of a mesh wire cloth such as a polypropylene wire. In one working embodiment the bed was circular shaped 18 inches in diameter and had a uniform thickness of $\frac{1}{8}$ of an inch. The bed was constructed with packed layers of a 10-square-mesh wire where each wire was 0.01 inches in cross-section diameter. This gave a total uniform thickness of $\frac{1}{8}$ inch to the bed. Each of the layers was slightly offset from its adjacent lamina to reduce or eliminate the possiblity of large holes through the bed. At the center of the bed there is a bonded epoxy area 3 bored to receive a drive shaft capable of supplying—via a hydraulic motor, etc.—a rotational effect of the bed. For the mentioned embodiment this bonded area was 2 inches in diameter. This bed was constructed so that small particles would pass into it and large particles would not be embedded in its surface.

Again referring to the same figure, there is a sheet metal housing 7 having a bell mouth air entry and supports 9 for the motor 11 used to rotate the bed. The bed rotates within this stationary housing. In one embodiment the motor was capable of generating less than 2 horsepower (hp) at 2,700 rpm and the entry to the housing was approximately 18 inches wide. In turn, the housing was mounted so that its narrower end was centered to form an exit and connected to a short length of duct 14 inches in diameter. The overall length of the housing with the bed mounted in it was 12 inches.

As the bed is rotated against the outside lip of the bell shaped housing an air seal, caused by the movement of air through the bed, is formed between the edges of the rotating bed and the interior surface of the bell shaped housing. To reduce friction the contacting surface of the housing may be coated with a low friction material such as Teflon. Further, the air seal tightness around the edges of the bed can be adjusted by moving the motor 11 either slightly forward or backward relative to the housing which will move its connected shaft and bed in the same direction.

Figure 2:
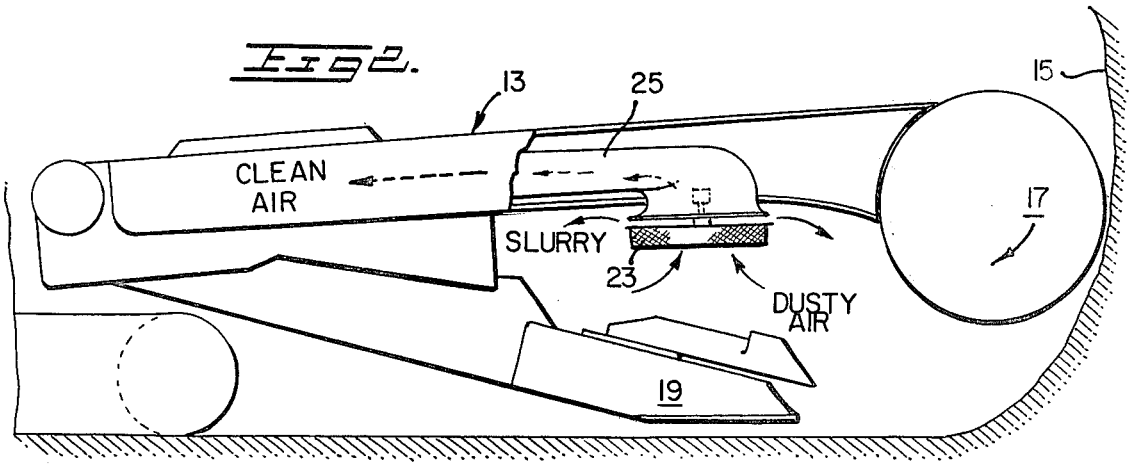
FIG. 2 is a schematic depiction, side view, of how the invention could be mounted to the auger support frame of a ripper type mining machine.

FIG. 2 shows how the scrubber assembly of FIG. 1 could be set up in conjunction with a mining machine 13. With the rotating drum continuous miner illustrated, coal or other material being mined is cut from the mine face 15 as the rotating cutter head's (17) bits contact the material. When this happens, dust-laden air is generated near the front of the mine as the cut material is gathered in by the arms 19. A remote fan 21 (not shown) forces the dust-laden air upwardly towards the scrubber housing assembly that has the rotating bed. The mining machines conventional water sprays wet the scrubber bed 1. Before actually encountering the assembly a heavy gauge protective screen 23 allows the bulk of the particles and dust-laden air to pass but protects the assembly against larger damage causing particles. After passing through this protective screen the dust encounters the rapidly rotating bed 1 as previously described. The motor 11 is located above the bed and screen and is connected via a drive shaft to the bed and its assembly.

After encountering the bed, the cleared air passes through it and is expelled via duct work 25 away from the mine working face 15. Dust particles and moisture are for the most part expelled as a slurry radially outward from the edge of the rotating bed and fall to the mined coal that is being loaded out by the mining machine. Test conducted have shown that with an air velocity of 2,000 fpm through the bed and at speeds above 600 rpm the bed provided adequate cleaning and prevented significant quantities of water from blowing axially through the bed. The typical velocity of air being forced through the bed filter is 2,000 ft/min and the respective rpm for the rotation of the bed is approximately 2700. Normally the particles in a coal mine that would be thrown off the bed and not pass through are those particles more than 1/16 of an inch in diameter. Tests show that at 2,750 rpm, 2,000 cfm, and 2.1 gpm, dust particles with an E.C.D. (effective cut diameter) of 1.1 microns (1 micron = 1/25,000 inches) were collected at efficiencies of 97–99 percent. If all particles more than 7 microns E.C.D. are considered, the collection efficiency for these same parameters averaged more than 99 percent. This was the highest efficiency results obtained out of those mentioned and tested. No known scrubbers produce better or equivalent results.

This invention has particular applicability to the coal mining field. Accordingly to the correct health and safety standards set by the 1969 Federal Coal Mine Health and Safety Act, the concentration of airborne respirable dust in coal mines must be 2.0 milligrams (mg) per cubic meter ($m^3$) of air or less for an average 8 hours work day. When scrubbers are utilized to achieve these desired results, safety, size, power requirements or other utility requirements negate the use of most standard industrial scrubbers. The preferred embodiment of this invention met all of the requirements for use in coal mines with the highest efficiency.

Although this invention has been disclosed in its preferred embodiment of the specific use in coal mines, none of the disclosed limitation should be used to limit the scope and extent of the invention which is to be measured only by the claims that follow.

I claim:

1. A combined air scrubber and water droplet eliminator assembly for removing dust particles from ambient air comprising:

a bed mount assembly having an opened housing with an entrance portion and an exit portion for allowing the air to enter and exit therethrough, the diameter of the entrance being larger than its exit;

a rotatable smooth surface fibrous bed made of uniform thickness and a layered mesh wire material, each wire being less than 0.01 of an inch in diameter and offset from the wire of adjacent lamina, said bed being mounted in the entrance portion of the housing and, when in an operative mode, bearing against the housing on all sides and so oriented as to receive a liquid spray and air from an air control means which forces ambient air into its smooth surface; and a motor assembly for causing the bed to rotate in its mounted position at a speed of at least 1,000 revolutions per minute as air is forced towards it and liquid sprayed on it, the combined effect of the rotation and forced air causing an air seal to form totally around the edges of the bed causing it to bear against the entrance of the housing, whereby as the dust and water drop laden airstream flows into the bed dust particles above a predetermined size and moisture content are stopped by the bed and slung from its edge surface.

2. The assembly of claim 1 wherein the mesh wire is a polypropylene material and the bed is approximately $\frac{1}{8}$ to $\frac{1}{4}$ inch thick.

3. The assembly of claim 1 also including in combination:

an underground mining machine having a material cutting head at its front end;

said air scrubber and water droplet eliminator assembly being mounted on said machine near its front end and rearward of its cutting head and adapted to receive airborne mining dust particles generated during the cutting operation.

* * * * *